US007746210B2

(12) United States Patent
MI et al.

(10) Patent No.: US 7,746,210 B2
(45) Date of Patent: Jun. 29, 2010

(54) ELECTRONIC DEVICE

(75) Inventors: Xiaoyu MI, Kawasaki (JP); Takeo Takahashi, Yokohama (JP); Tsuyoshi Matsumoto, Kawsaki (JP); Satoshi Ueda, Kawasaki (JP)

(73) Assignees: Fujitsu Media Devices Limited, Yokohama (JP); Fujitsu Limited, Kawasaki (JP)

( * ) Notice: Subject to any disclaimer, the term of this patent is extended or adjusted under 35 U.S.C. 154(b) by 10 days.

(21) Appl. No.: 12/237,826

(22) Filed: Sep. 25, 2008

(65) Prior Publication Data

US 2009/0085707 A1 Apr. 2, 2009

(30) Foreign Application Priority Data

Sep. 28, 2007 (JP) ..... 2007-254662

(51) Int. Cl.
*H01F 5/00* (2006.01)

(52) U.S. Cl. ..... 336/200

(58) Field of Classification Search ..... 336/65, 336/83, 192, 200, 232; 257/531
See application file for complete search history.

(56) References Cited

U.S. PATENT DOCUMENTS

| | | | | |
|---|---|---|---|---|
| 6,518,165 | B1 | 2/2003 | Yoon et al. | |
| 6,590,473 | B1 * | 7/2003 | Seo et al. | 333/185 |
| 7,157,984 | B2 * | 1/2007 | McCorquodale et al. | 331/167 |
| 2004/0104449 | A1 * | 6/2004 | Yoon et al. | 257/528 |
| 2006/0114077 | A1 | 6/2006 | Mizuno et al. | |
| 2007/0045773 | A1 | 3/2007 | Mi et al. | |

FOREIGN PATENT DOCUMENTS

| | | | |
|---|---|---|---|
| JP | 2006-157738 | A | 6/2006 |
| JP | 2007-67236 | A | 3/2007 |

* cited by examiner

*Primary Examiner*—Tuyen Nguyen
(74) *Attorney, Agent, or Firm*—Arent Fox LLP

(57) ABSTRACT

An electronic device includes a substrate, a first coil that has a spiral shape and is provided on the substrate, a second coil that has a spiral shape, is provided above the first coil, and is spaced from the first coil, a first connection portion that electrically couples the first coil and the second coil, a wire that is provided on the substrate and connects one of the first coil and the second coil to outside, and a second connection portion that is mechanically connected to an outer side face of outermost circumference of the second coil and is mechanically connected on the substrate where one of the wire and the first coil is not provided.

9 Claims, 17 Drawing Sheets

ELECTRONIC DEVICE

BACKGROUND OF THE INVENTION

1. Field of the Invention

The present invention generally relates to an electronic device, and more particularly, to an electronic device having spiral-shaped coils longitudinally spaced from each other.

2. Description of the Related Art

An inductor or a capacitor is used for phase matching or the like. For example, there is a demand for downsizing, low cost and high performance in a RF system such as mobile phone or wireless LAN (Local Area Network). An electronic device such as an integrated passive device where passive devices such as an inductor or a capacitor are integrated on a substrate is used in order to satisfy the demand.

Japanese Patent Application Publication No. 2006-157738 discloses an integrated electronic device using a spiral-shaped coil on a substrate acting as an inductor. Japanese Patent Application Publication No. 2007-67236 and U.S. Pat. No. 6,518,165 disclose an inductor in which spiral-shaped coils are longitudinally spaced from each other.

In accordance with the inductor disclosed in Japanese Patent Application Publication No. 2007-67236, high Q value is obtained. There is, however, a problem that mechanical strength and impact resistance of an upper layer coil are not sufficient, because the coils are longitudinally spaced from each other in the inductor disclosed in Japanese Patent Application Publication No. 2007-67236.

SUMMARY OF THE INVENTION

The present invention has been made in view of the above circumstances and provides an electronic device having spiral-shaped coils longitudinally spaced from each other, in which mechanical strength and impact resistance are improved and inductor property is improved.

According to an aspect of the present invention, there is provided an electronic device including a substrate, a first coil that has a spiral shape and is provided on the substrate, a second coil that has a spiral shape, is provided above the first coil, and is spaced from the first coil, a first connection portion that electrically couples the first coil and the second coil, a wire that is provided on the substrate and connects one of the first coil and the second coil to outside, and a second connection portion that is mechanically connected to an outer side face of outermost circumference of the second coil and is mechanically connected on the substrate where one of the wire and the first coil is not provided.

With the structure, mechanical strength and impact resistance of the second coil may be improved because the second coil is mechanically connected to outside with the second connection portion. Inductor property may be improved because the second connection portion is mechanically connected to the outer side face of the outermost circumference of the second coil.

DESCRIPTION OF THE PREFERRED EMBODIMENTS

In order to facilitate better understanding of the present invention, a description will now be given of related art.

Figure 1:
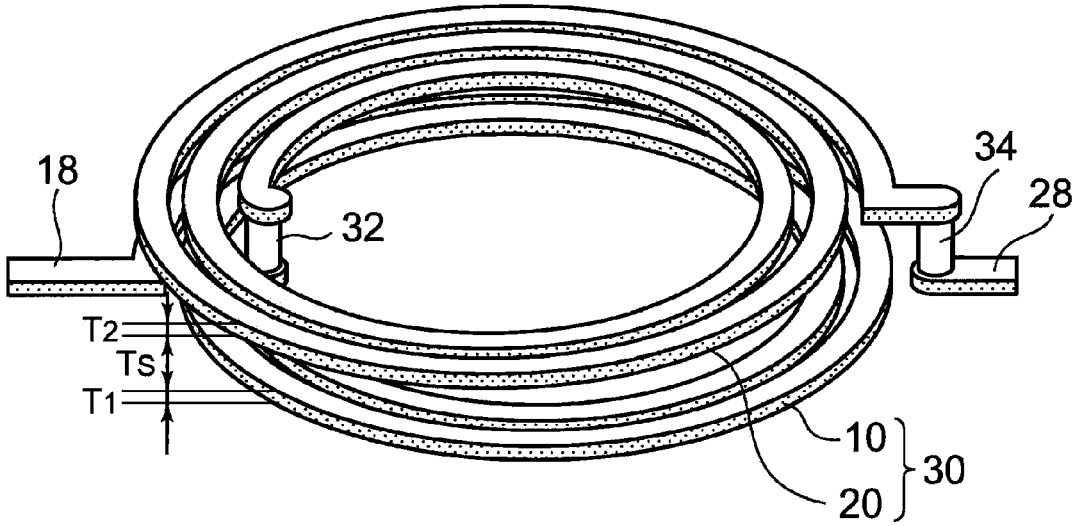
FIG. 1 illustrates a perspective view of an inductor in accordance with a first comparative embodiment.
Figure 2:
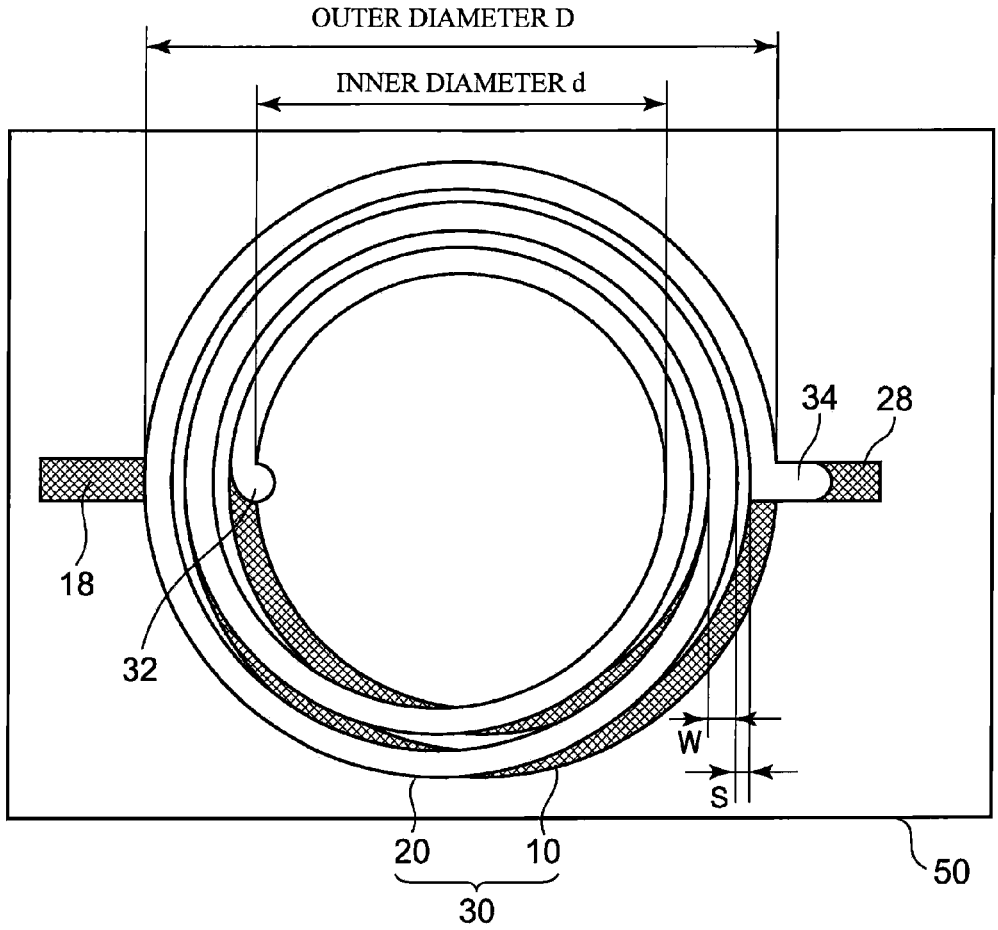
FIG. 2 illustrates a top view of the inductor in accordance with the first comparative embodiment.

FIG. 1 illustrates a perspective view of an inductor in accordance with a first comparative embodiment of which number of turns is 4.5 (a number of turns of a second coil 20 and a first coil 10 is 2.5 and 2 respectively). FIG. 2 illustrates a top view of the inductor. As shown in FIG. 1 and FIG. 2, the first coil 10 having a spiral shape is provided on a substrate 50 made of glass, and the second coil 20 having a spiral shape is provided on the first coil 10. The first coil 10 and the second coil 20 are spaced from each other. A space is formed between the first coil 10 and the second coil 20. That is, air is filled between the first coil 10 and the second coil 20. The first coil 10 is almost overlapped with the second coil 20. There are provided wires 18 and 28 that are made of the same metal layer as the first coil 10 and are configured to be connected to outside of an inductor 30. The wire 18 is directly connected to an end of an outermost circumference (that is an outer end) of the first coil 10. A third connection portion 34 is provided at an end of an outermost circumference of the second coil 20. The wire 28 is electrically coupled to the second coil 20 via the third connection portion 34. A first connection portion 32 is provided at an end of innermost circumference (that is an inner end) of the first coil 10 and the second coil 20. The first coil 10 and the second coil 20 are electrically coupled to each other via the first connection portion 32. The inductor 30 has the first coil 10 and the second coil 20 that are spaced from each other in a longitudinal direction on the substrate 50, are electrically coupled to each other, and have a spiral shape.

Figure 3:
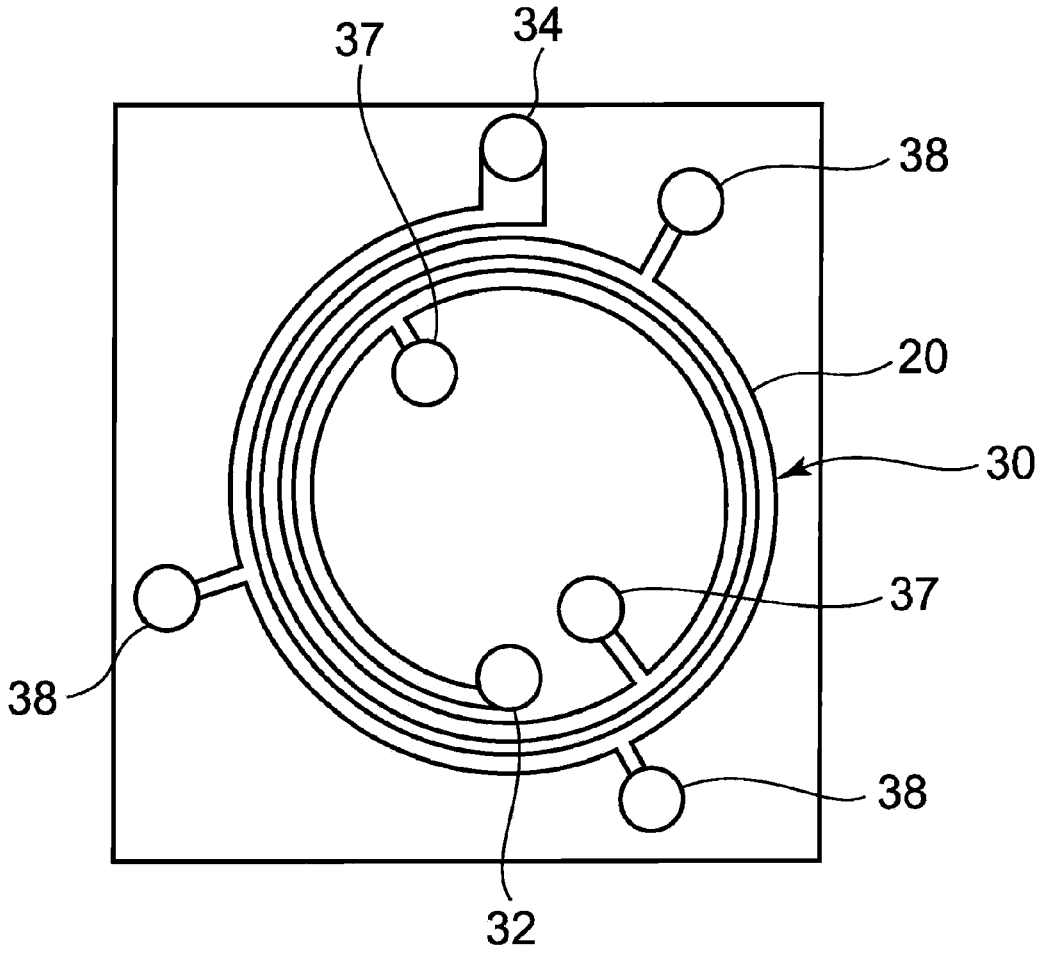
FIG. 3 illustrates a top view of an inductor in accordance with a second comparative embodiment.

FIG. 3 illustrates a top view of an inductor in accordance with a second comparative embodiment (the first coil 10 is not shown). Two fourth connection portions 37 are connected to an inner side face of the innermost circumference of the second coil 20. Three second connection portions 38 are connected to an outer side face of the outermost circumference of the second coil 20. The second connection portion 38 and the fourth connection portion 37 have the same structure as the first connection portion 32 and the third connection portion 34. The other structure of the inductor is as same as that of the first comparative embodiment.

Figure 4A:
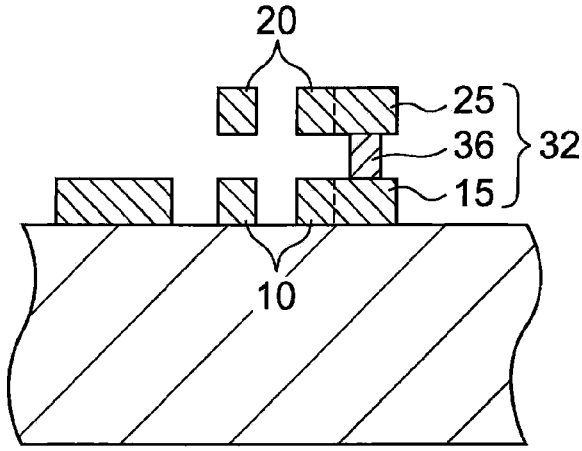
FIG. 4A through FIG. 4C illustrate a cross sectional view of a connection portion in accordance with the second comparative embodiment.
Figure 4B:
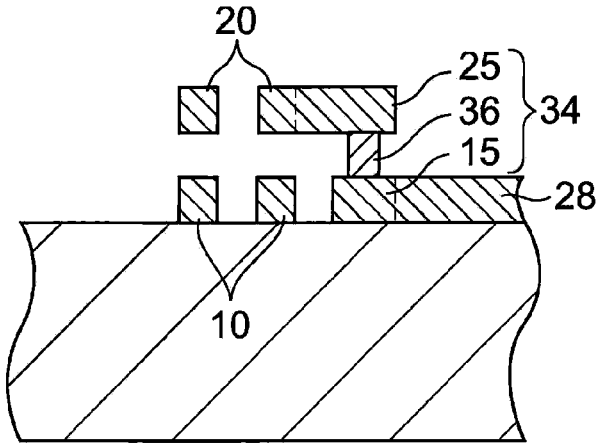
Figure 4C:
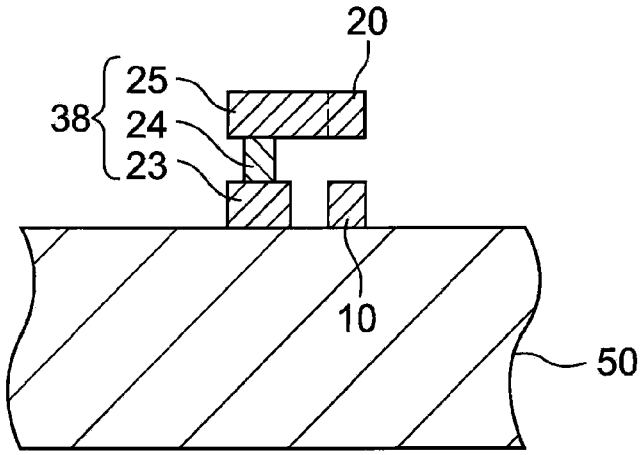

FIG. 4A through FIG. 4C illustrate a cross sectional view around the first connection portion 32, the third connection portion 34 and the second connection portion 38 respectively. As shown in FIG. 4A, the first connection portion 32 is structured with a reception portion 15, a support column 36 and a reception portion 25. The support column 36 is formed between the reception portion 15 and the reception portion 25. The reception portion 15 is directly connected to the first coil 10. The reception portion 25 is directly connected to the second coil 20. As shown in FIG. 4B, the third connection portion 34 is structured with the reception portion 15, the support column 36 and the reception portion 25. The support column 36 is formed between the reception portion 15 and the reception portion 25. The reception portion 15 is directly connected to the wire 28. The reception portion 25 is directly connected to the second coil 20. As shown in FIG. 4C, the second connection portion 38 is structured with a base portion 23, a support column 24 and the reception portion 25. A support column 24 is formed between the base portion 23 and the reception portion 25. The reception portion 25 is directly connected to the side face of the second coil 20. The base portion 23 is provided on the substrate 50. The base portion 23 is not electrically coupled to the wires 18 and 28 and the first coil 10. That is, the second connection portion 38 is provided on the substrate 50 where the wires 18 and 28 or the first coil 10 is not provided. The fourth connection portion 37 has the same structure as the second connection portion 38.

The first coil 10, the wire 28, the reception portion 15 and the base portion 23 are a metal layer that has thickness of approximately 10 μm and are made of copper formed with a plating method. The first coil 10, the wire 28, the reception portion 15 and the base portion 23 are formed together with each other. The second coil 20 and the reception portion 25 are a metal layer that has thickness of approximately 10 μm and are made of copper formed with a plating method. The second coil 20 and the reception portion 25 are formed together with each other. The second connection portion 38 is made of material that is the same as that of the first connection portion 32 and the third connection portion 34. It is therefore possible to simplify the manufacturing process of forming the second connection portion 38 and the fourth connection portion 37.

In accordance with the second comparative embodiment, the second connection portion 38 and the fourth connection portion 37 having electrical conductivity are mechanically connected to the side face of the second coil 20 and to the surface of the surface of the substrate 50. It is therefore possible to improve mechanical strength and impact resistance of the second coil 20.

Figure 5:
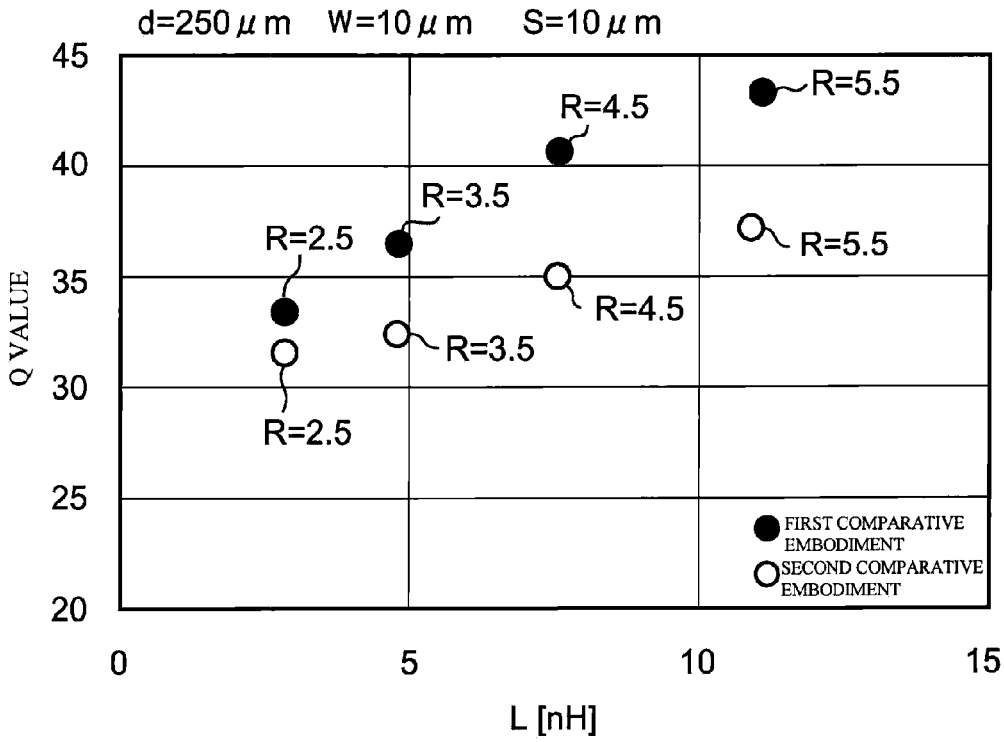
FIG. 5 illustrates a Q value with respect to L of the inductors in accordance with the first comparative embodiment and the second comparative embodiment.

FIG. 5 illustrates a measured Q value with respect to an inductance value L of the inductors in accordance with the first comparative embodiment and the second comparative embodiment. A black circle and a white circle show the first comparative embodiment and the second comparative embodiment respectively. The first coil 10 and the second coil 20 of the first comparative embodiment and the second comparative embodiment are made of copper. Thickness T1 of the first coil 10 and thickness T2 of the second coil 20 are approximately 10 μm. A distance TS between the first coil 10 and the second coil 20 is 30 μm. An inner diameter d of the inductor, a line width W and a line interval S are respectively 250 μm, 10 μm and 10 μm. The number R of turns of the inductor 30 is 2.5 to 5.5. A measured frequency is 1.93 GHz.

As shown in FIG. 5, the Q value of the first comparative embodiment is approximately equal to that of the second comparative embodiment, when the inductance value L is low. The Q value of the second comparative embodiment is lower than that of the first comparative embodiment, when the inductance value L is high. The Q value of the second comparative embodiment is lower than that of the first comparative embodiment because of eddy-current loss caused by eddy-current generated in the second connection portion 38 and the fourth connection portion 37.

First Embodiment

Figure 6A:
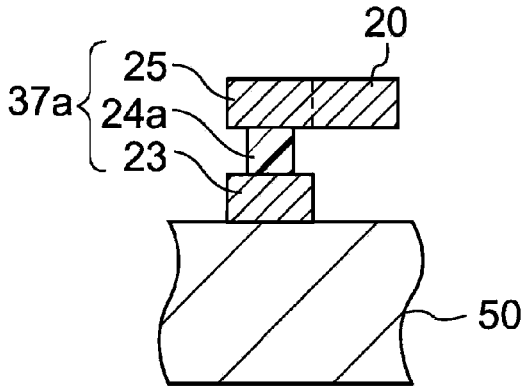
FIG. 6A and FIG. 6B illustrate a cross sectional view of the second connection portion in accordance with a first embodiment.
Figure 6B:
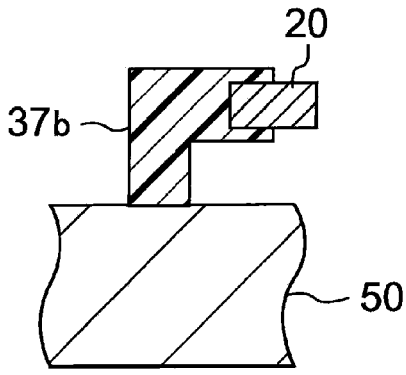

It is preferable that the fourth connection portion 37 includes an insulator in order to restrain the eddy-current loss, because magnetic flux density of the inner side of the inductor 30 is larger than that of the outer side thereof. As shown in FIG. 6A, a support column 24*a* between the base portion 23 and the reception portion 25 is made of an insulator such as polyimide or BCB (Benzocyclobutene) in a fourth connection portion 37*a* in accordance with the first embodiment. As shown in FIG. 6B, a fourth connection portion 37*b* is made of an insulator such as polyimide or BCB (Benzocyclobutene) in another version of the first embodiment. The fourth connection portion 37*b* holds the side faces of the second coil 20. It is preferable that a whole of a fourth connection portion 39*b* is made of insulator as shown in FIG. 6B, from the eddy-current loss viewpoint.

It is preferable that both of the fourth connection portion 37 and the second connection portion 38 include an insulator. Either the second connection portion 38 or the fourth connection portion 37 may, however, include the insulator. It is possible to restrain influence of the eddy-current and support the second coil 20 mechanically if the inner fourth connection portion 37 includes the insulator and the outer second connection portion 38 is conductive from the eddy-current loss view point, because the magnetic field generated by the inductor 30 is larger on the inner side of the inductor 30.

It is preferable that the substrate 50 is made of highly insulating material in the first embodiment. The substrate 50 may be made of an insulating substrate such as quartz (including synthetic quartz), glass (pyrex (registered trademark), tempax, alumino silicate, borosilicate glass) and ceramics, or a high-resistance silicon substrate. The substrate 50 may be made of a high-resistance Si substrate, a $LiNbO_3$ substrate, or a $LiTaO_3$ substrate. It is preferable that the first coil 10 and the second coil 20 are made of low-resistance metal. The first coil 10 and the second coil 20 may be made of gold, aluminum, silver in addition to copper. It is preferable that the layer of the first coil 10 in touch with the substrate 50 is made of high-melting point metal having high adhesiveness to the substrate, for example metal such as Ti, Cr, Ni, Mo, Ta, W or alloy including at least one of Ti, Cr, Ni, Mo, Ta, W. The manufacturing method of the inductor in accordance with the first embodiment may be that of Japanese Patent Application Publication No. 2007-67236.

The Q value is reduced when the outer diameter D is reduced. The chip size is enlarged when the outer diameter D is enlarged. The outer diameter D may be determined in view of the above relations. It is preferable that the outer diameter D is 100 μm to 1 mm. The wire width W may be determined so that the resistance is not enlarged and d/D is not reduced. It is preferable that the wire width W is 3 μm to 100 μm. The wire interval S may be determined so that wires are inductively connected to each other and the d/D is not reduced. It is preferable that the wire interval S is 3 μm to 100 μm. The number of turns R may be determined optimally according to the d/D, the wire width W and the wire interval S, and is preferably 0.5 to 30.

The thickness T1 of the first coil 10 and the thickness T2 of the second coil 20 may be determined in a range where the resistance is not large and the inductor is manufactured easily. It is preferable that the thickness T1 and T2 is 3 μm to 30 μm. The distance TS between the first coil 10 and the second coil 20 may be determined so that parasitic capacitance is reduced and the inductive connection is enlarged. It is preferable that the distance TS is 3 μm to 40 μm.

Second Embodiment

Figure 7:
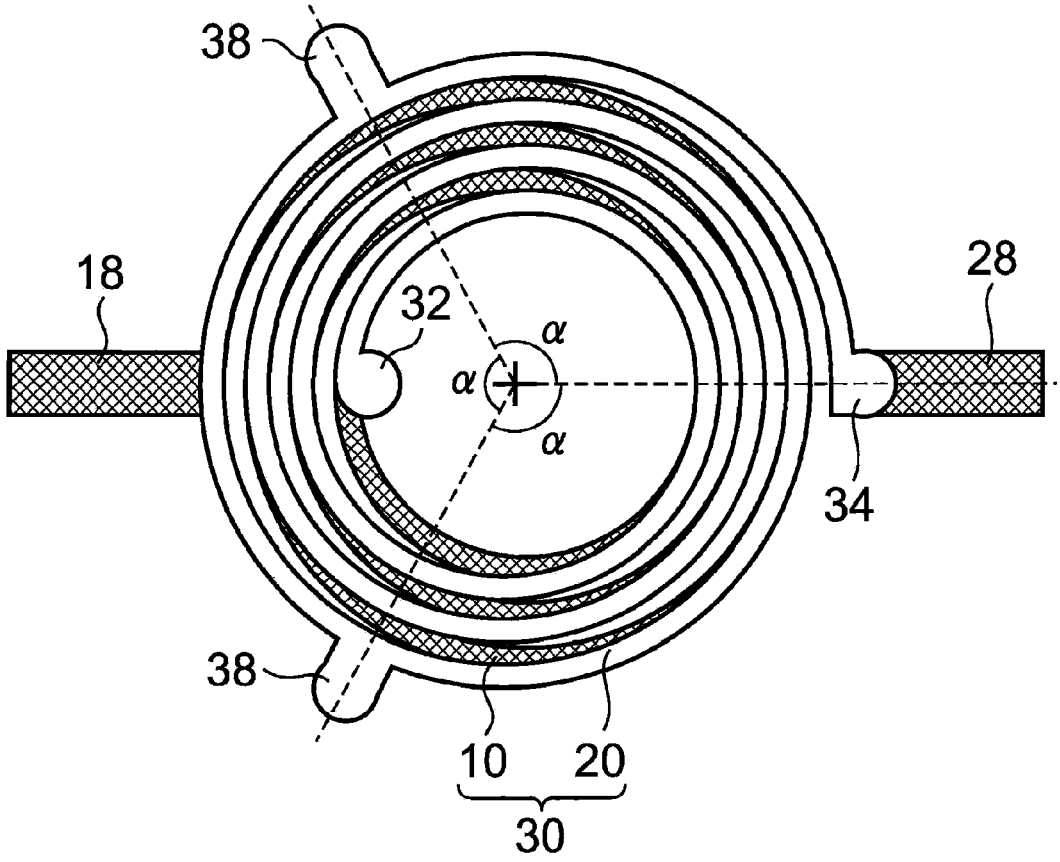
FIG. 7 illustrates a top view of an inductor in accordance with a second embodiment.
Figure 8:
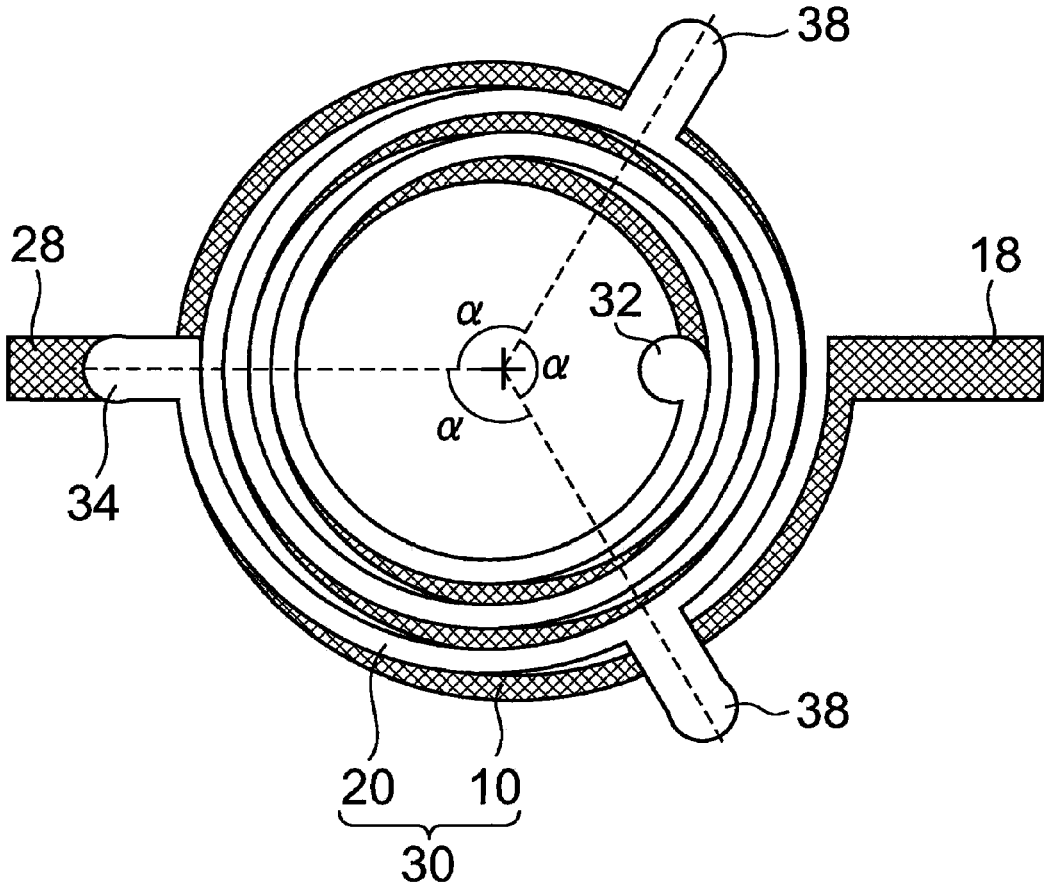
FIG. 8 illustrates another top view of the inductor in accordance with the second embodiment.
Figure 9:
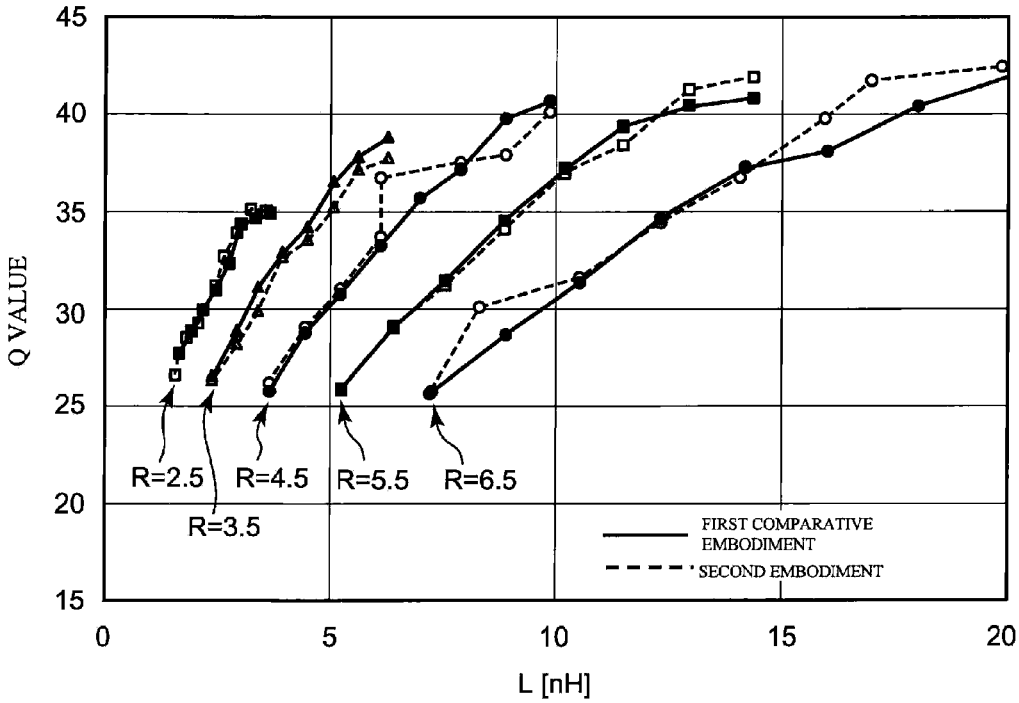
FIG. 9 illustrates a Q value of L of the inductor in accordance with the second embodiment.

A second embodiment is an example where the second connection portion is provided only outside of an inductor. FIG. 7 and FIG. 8 illustrate a top view of an inductor in accordance with the second embodiment. FIG. 7 illustrates an inductor having the number of turns R of 6.5 (a number of turns of the first coil 10 and the second coil 20 are 3 and 2.5 respectively). FIG. 8 illustrates an inductor having the number of turns R of 5.5 (a number of turns of the first coil 10 and the second coil 20 are 3 and 2.5 respectively). In the second embodiment, the fourth connection portion 37 on the inside is not provided. There are provided two second connection portions 38 on the outside. The angle α formed with the two second connection portions 38 and the third connection portion 34 in the center of the inductor 30 is approximately equal to each other. The structure of the second connection portion 38 is the same as that of FIG. 4C in the first embodiment. That is, the whole of the second connection portion 38 is electrically conductive. FIG. 9 illustrates the Q value with respect to the inductance value L of the inductor in accordance with the first comparative embodiment and the second embodiment. Black dots connected with a solid line indicate the first comparative embodiment. White dots connected with a dashed line indicate the second embodiment. The thickness T1 and T2, the distance TS, the wire width W and the wire interval S of the manufactured coil of the second embodiment and the first comparative embodiment are the same as those of the first embodiment. FIG. 9 illustrates inductors having the number of turns R of 6.5 to 2.5 and the inner diameter of 125 μm to 300 μm at every 25 μm.

The Q value is approximately equal to each other between the first comparative embodiment and the second embodiment. This is because eddy current loss is restrained when the second connection portion 38 is not provided inside of the second coil 20 having large magnetic flux density. As shown in FIG. 4A through FIG. 4C, the manufacturing process may be simplified if the first connection portion 32 and the second connection portion 38 are formed together with each other. However, the second connection portion 38 and the fourth connection portion 37 are electrically conductive because the first connection portion 32 is electrically conductive. This results in eddy current loss caused by the second connection portion 38 and the fourth connection portion 37. In accordance with the second embodiment, the second connection portion 38 is mechanically connected to the outer side face of the outermost circumference of the second coil 20. The second connection portion 38 is not provided inside of the second coil 20. It is therefore possible to restrain the eddy current loss even if the second connection portion 38 is electrically conductive. The second connection portion 38 is formed on the substrate 50 where the wires 18 and 28 or the first coil 10 is not provided. That is, the second connection portion 38 is not provided between the first coil 10 and the second coil 20 (that is the lower face of the second coil 20). It is therefore possible to restrain the eddy current loss.

Figure 10:
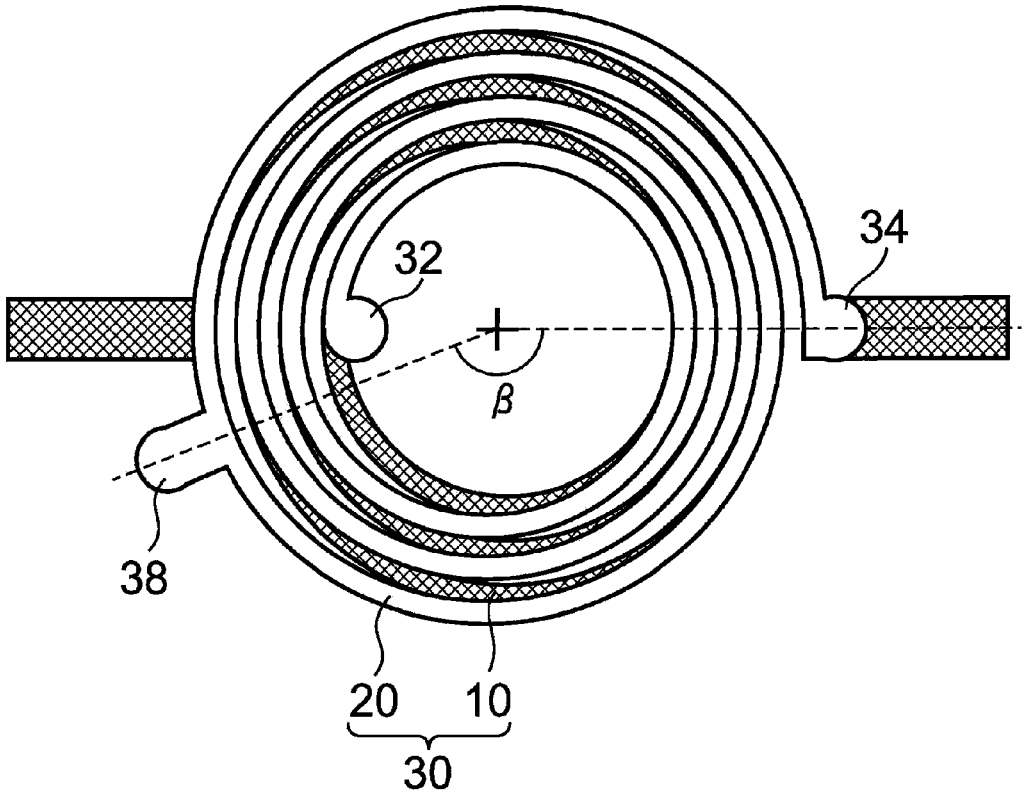
FIG. 10 illustrates a top view of an inductor in accordance with a first variant of the second embodiment.
Figure 11:
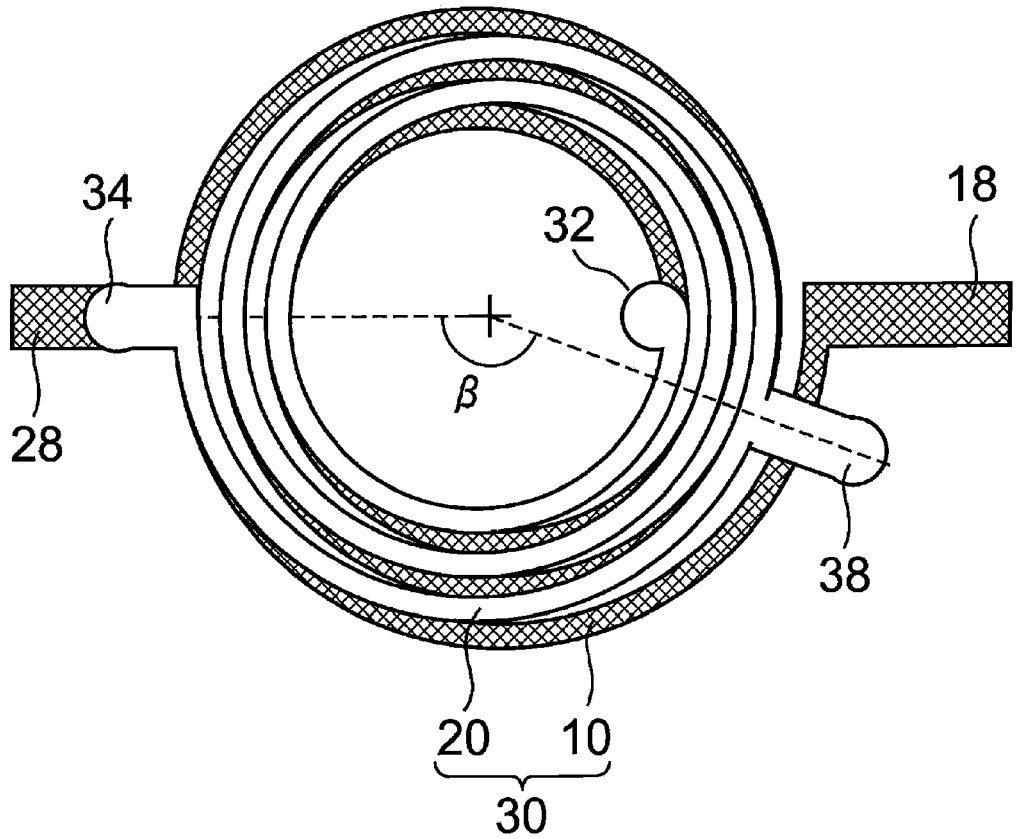
FIG. 11 illustrates another top view of the inductor in accordance with the first variant of the second embodiment.
Figure 12:
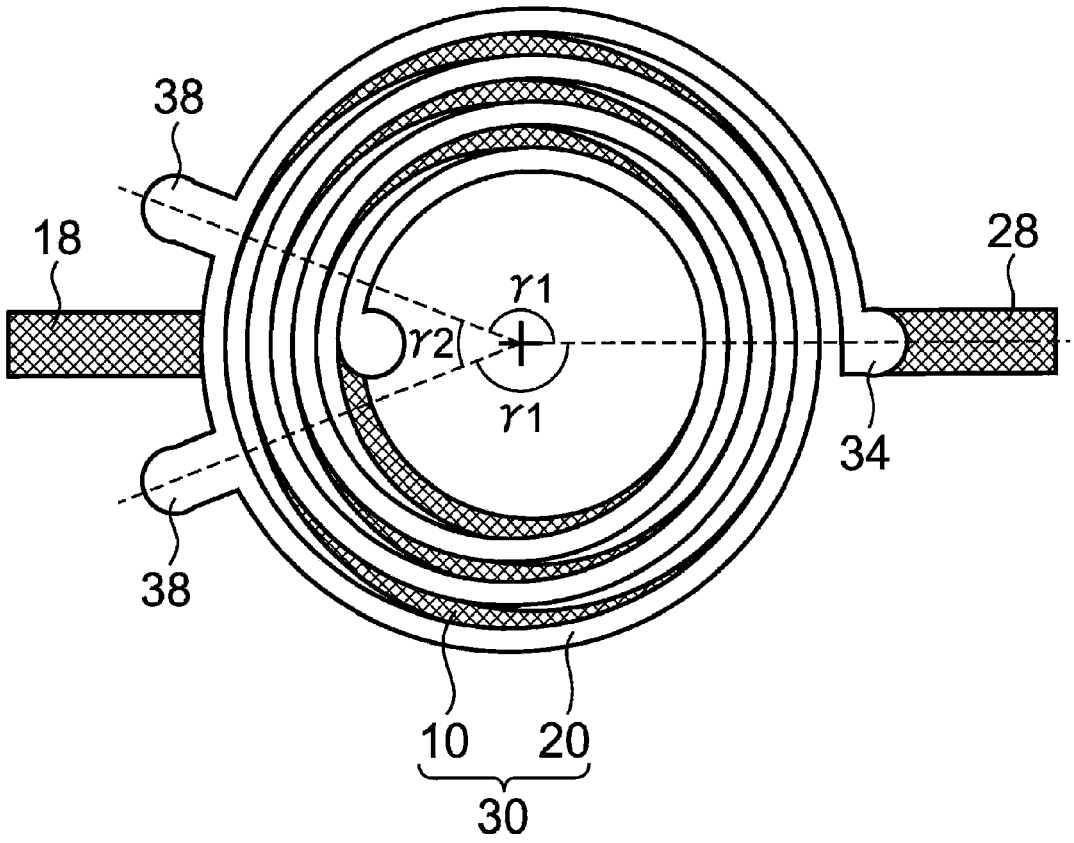
FIG. 12 illustrates a top view of an inductor in accordance with a second variant of the second embodiment.
Figure 13:
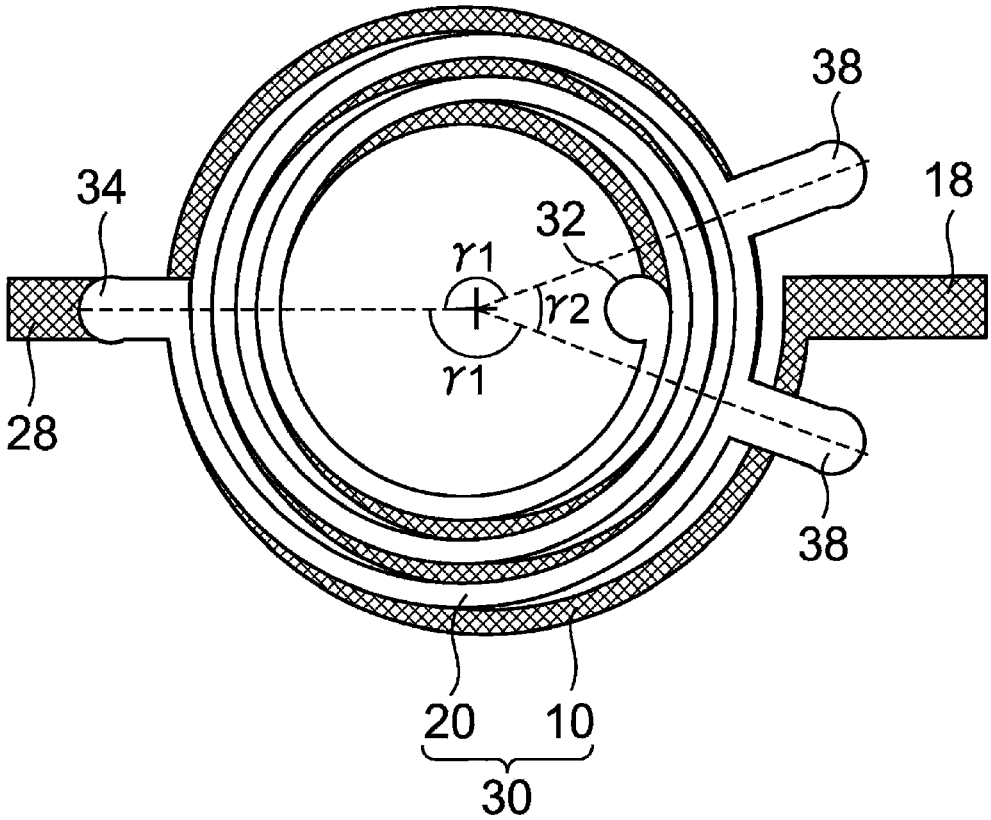
FIG. 13 illustrates another top view of the inductor in accordance with the second variant of the second embodiment.

FIG. 10 and FIG. 11 illustrate a first variant embodiment of the second embodiment. FIG. 12 and FIG. 13 illustrate a second variant embodiment of the second embodiment. FIG. 10 and FIG. 12 illustrate an inductor having the number of turns R of 6.5. FIG. 11 and FIG. 13 illustrate an inductor having the number of turns R of 5.5. The second connection portion 38 and the third connection portion 34 are arranged at approximately equal interval in the second embodiment, as in the case of FIG. 7 and FIG. 8. In contrast, the angle β formed with the second connection portion 38 and the third connection portion 34 in the center of the inductor 30 is approximately 180 degrees in the first variant embodiment, as in the case of FIG. 10 and FIG. 11. The second connection portion 38 and the third connection portion 34 are provided at corners opposed to each other. As shown in FIG. 12 and FIG. 13, an angle γ2 formed with the two second connection portions 38 is smaller than an angle γ1 formed with the third connection portion 34 and the second connection portion 38, in the center of the inductor 30 in the second variant embodiment. The two second connection portions 38 are provided adjacent to each other.

Figure 14:
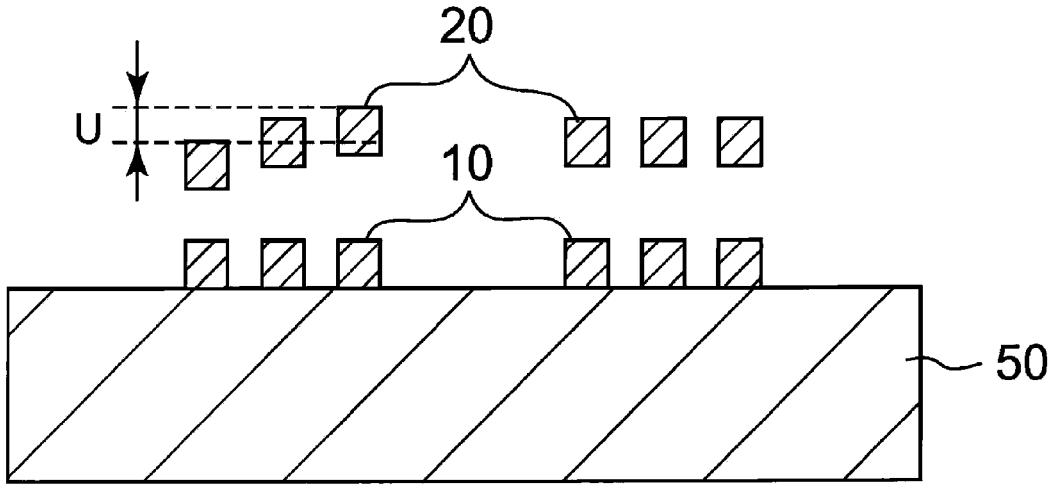
FIG. 14 illustrates a swell of an inductor.

The second coil 20 is out of alignment and moves upward because of inner stress thereof, when the second coil 20 is formed with a plating method. FIG. 14 illustrates a schematic cross sectional view of the inductor. The outer portion of the second coil 20 does not move because the outer portion is fixed with the second connection portion 38. The inner portion of the second coil 20 moves upward because the inner portion is not fixed with the second connection portion 38. A differential between the maximum height and the minimum height of the top face of the second coil 20 is defined as swell U.

Table 1 and Table 2 show the swell U in cases where the number of turns R is 6.5 and 5.5. As shown in Table 1 and Table 2, the swell U is restrained, when the second connection portion 38 and the third connection portion 34 are arranged on the outer circumference of the second coil 20 at substantially equal interval as the case of the second embodiment. The swell U is restrained in the case of the first variant embodiment when the number of turns R is 5.5

TABLE 1

| | W (μm) | S (μm) | U (μm) |
|---|---|---|---|
| FIRST VARIANT EMBODIMENT | 12.5 | 15 | 10.09 |
| SECOND VARIANT EMBODIMENT | 12.5 | 15 | 7.13 |
| SECOND EMBODIMENT | 12.5 | 12.5 | 4.60 |
| SECOND EMBODIMENT | 12.5 | 15 | 4.74 |
| SECOND EMBODIMENT | 15 | 12.5 | 5.62 |
| SECOND EMBODIMENT | 15 | 15 | 4.96 |
| SECOND EMBODIMENT | 17.5 | 15 | 4.23 |

TABLE 2

| | W (μm) | S (μm) | U (μm) |
|---|---|---|---|
| FIRST VARIANT EMBODIMENT | 12.5 | 15 | 5.26 |
| SECOND VARIANT EMBODIMENT | 12.5 | 15 | 7.58 |
| SECOND EMBODIMENT | 12.5 | 15 | 4.96 |
| SECOND EMBODIMENT | 15 | 15 | 5.69 |
| SECOND EMBODIMENT | 17.5 | 15 | 5.30 |

Figure 15:
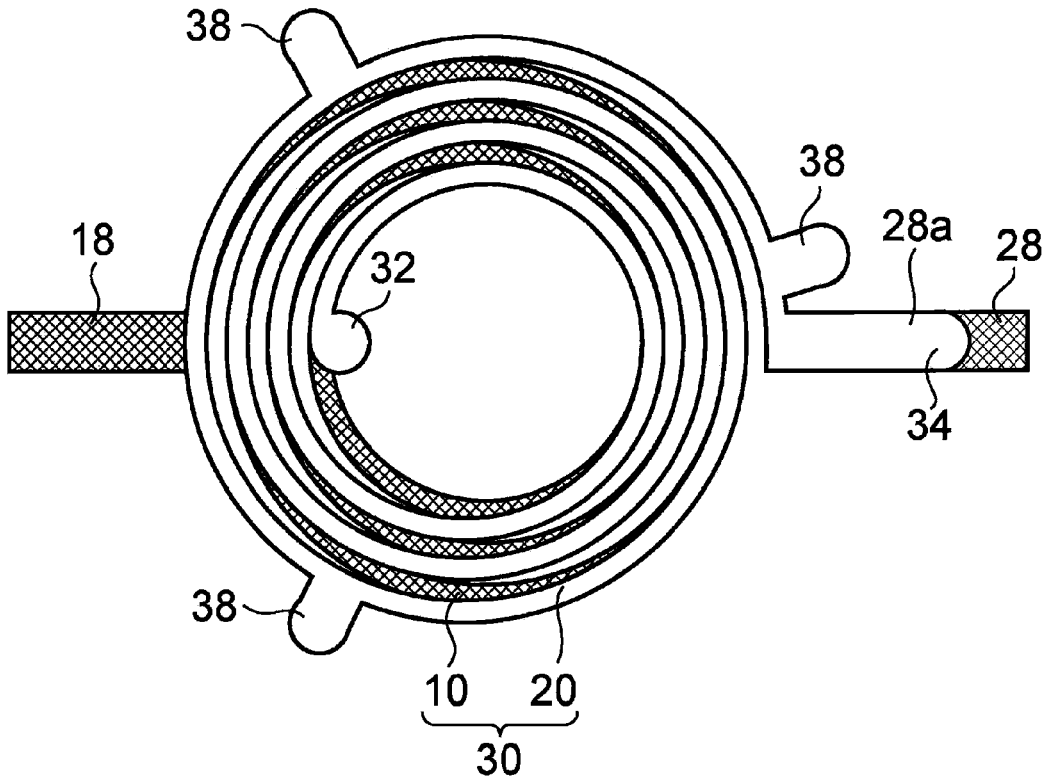
FIG. 15 illustrates a top view of an inductor in accordance with a third variant of the second embodiment.

FIG. 15 illustrates a top view of an inductor in accordance with a third variant embodiment of the second embodiment. A wire 28*a* made of the same metal layer as the second coil 20 is connected to the end of the outermost circumference of the second coil 20. The wire 28*a* is extracted to outside of the second coil 20, and is connected to the wire 28 formed on the substrate 50 with the third connection portion 34. It is preferable that the second connection portion 38 provided on the outer side face of the outermost circumference of the second coil 20 is arranged on the outer circumference of the second coil 20 at substantially equal interval, when the third connection portion 34 is separated from the second coil 20. In this case, the swell U is restrained as the case of the second embodiment.

Third Embodiment

Figure 16:
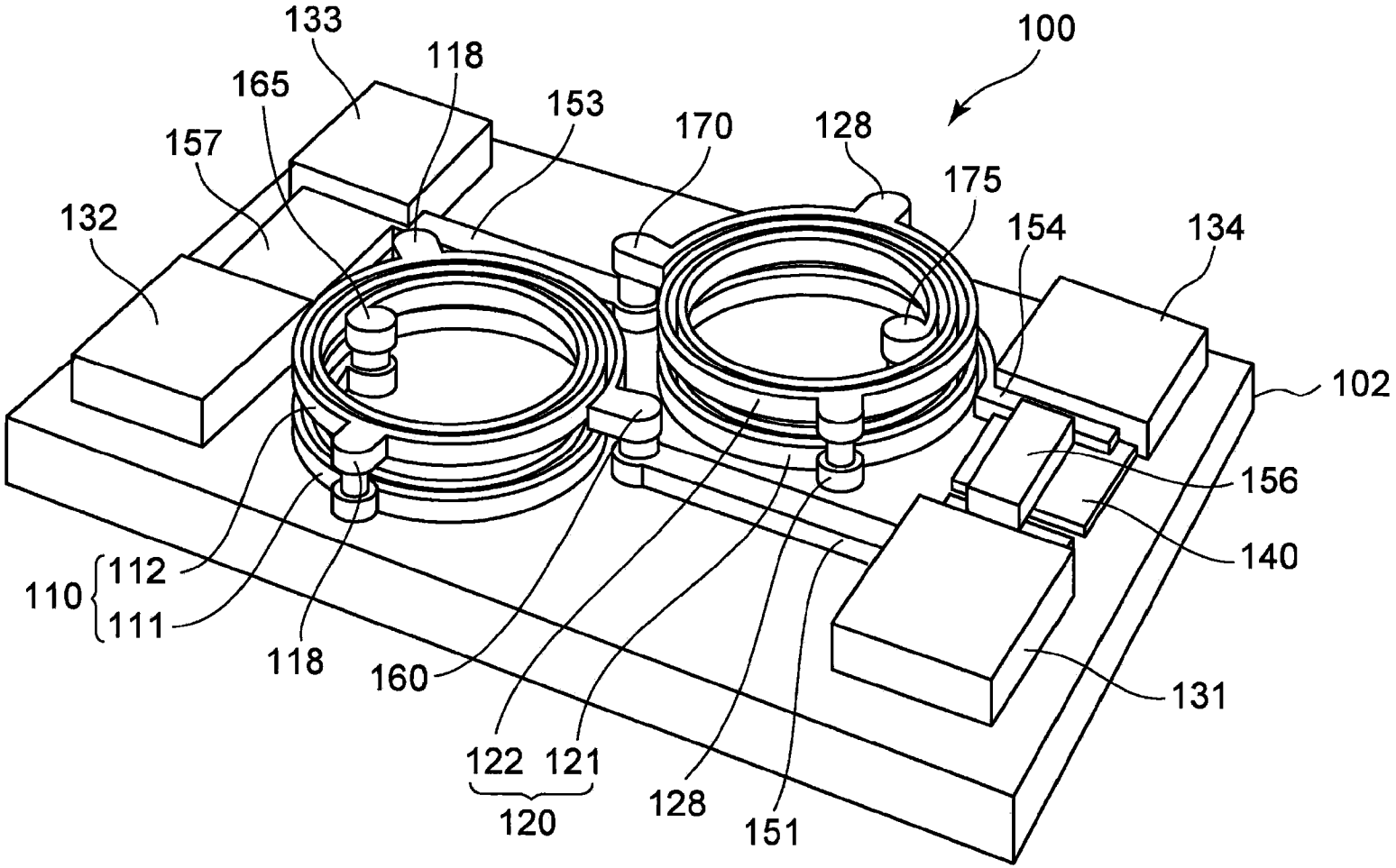
FIG. 16 illustrates a perspective view of an integrated passive device in accordance with a third embodiment.
Figure 17:
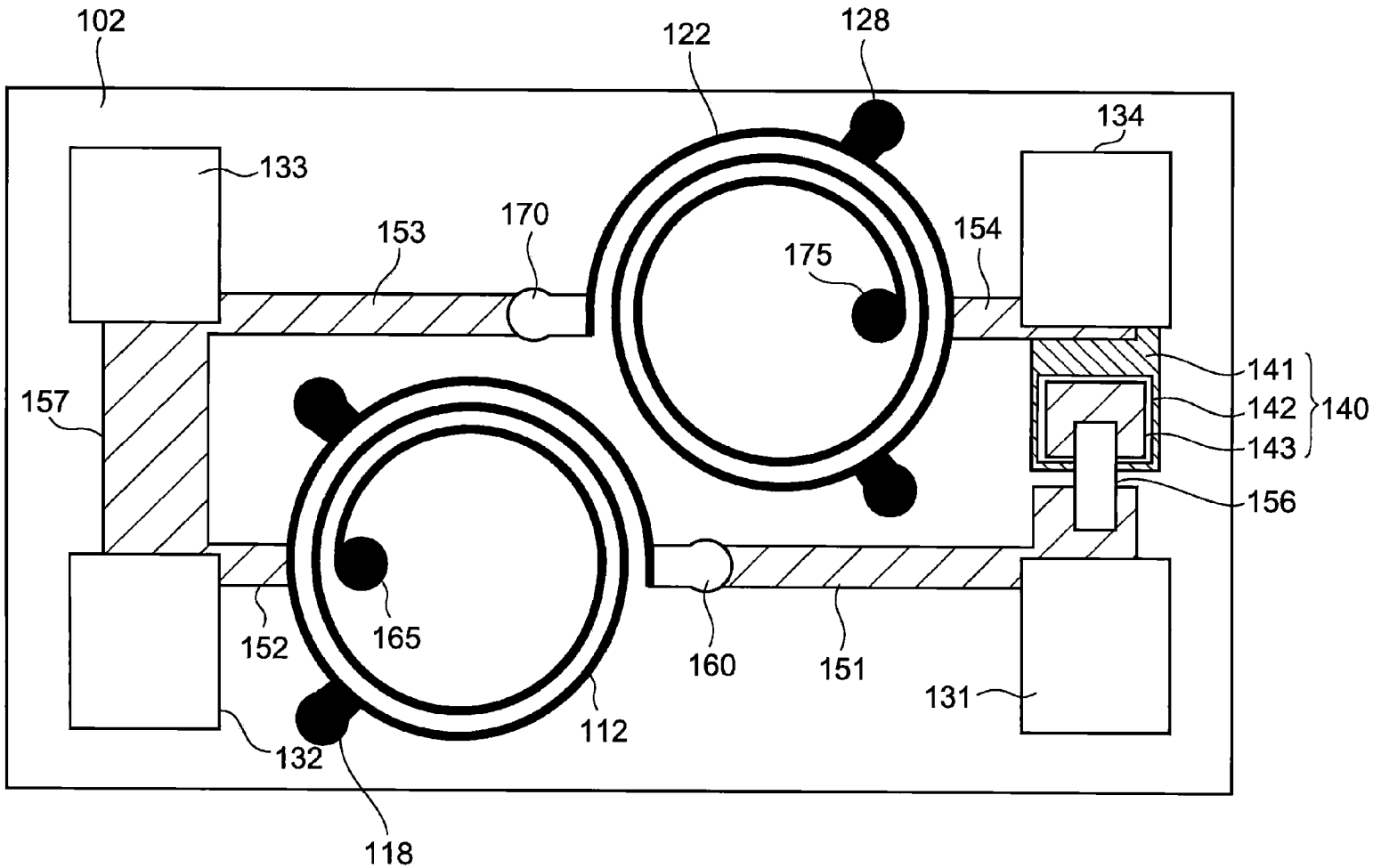
FIG. 17 illustrates a top view of the integrated passive device in accordance with the third embodiment.

A third embodiment is an example of an integrated passive device having the inductor in accordance with the second embodiment. FIG. 16 illustrates a perspective view of the integrated passive device in accordance with the third embodiment. FIG. 17 illustrates a top view of the integrated passive device. First coils 111 and 121 are not shown in FIG. 17. As shown in FIG. 16 and FIG. 17, there are provided an inductor 110 having the first coil 111 and a second coil 112 and an inductor 120 having the first coil 121 and a second coil 122. The inductors 11 and 120 are the inductor in accordance with the second embodiment. The inner end of the first coil 111 and the second coil 112 in the inductor 110 is electrically connected to each other through a first connection portion 165. The outer end of the first coil 111 is connected to a wire 152. The outer end of the second coil 112 is electrically connected to a wire 151 through a third connection portion 160. The second coil 112 is held by a second connection portion 118 at the side face of the outermost circumference thereof.

The inner end of the first coil 121 and the second coil 122 in the inductor 120 are connected to each other with a first connection portion 175. The outer end of the first coil 121 is connected to a wire 154. The outer end of the second coil 122 is connected to a wire 153 through a third connection portion 170. The second coil 122 is held by a second connection portion 128 at the side face of the outermost circumference thereof. The wires 151 through 154 are formed on a substrate 102 and connected to pads 131 through 134 respectively. The pad 132 is connected to the pad 133 with a wire 157. A capacitor 140 having a lower electrode 141, a dielectric layer 142 and an upper electrode 143 is connected between the pad 131 and the pad 134. The upper electrode 143 is connected to the wire 151 with an upper wire 156. An integrated passive device 100 forms a $\pi$ type L-C-L circuit between the pad 131 and the pad 134, if the pad 131 acts as an input, the pad 134 acts as an output, and the pad 132 and the pad 133 are grounded.

In accordance with the third embodiment, the inductor 110 and the inductor 120 in the integrated passive device 100 are structured with the inductor in accordance with the second embodiment. Mechanical strength and impact resistance of the inductors 110 and 120 may be improved, because the second connection portions 118 and 128 hold the second coils 112 and 122 respectively. The swell of the second coil 112 may be restrained, because the two second connection portions 118 and the third connection portion 160 are arranged at an equal interval. The manufacturing process may be simplified because the first connection portion 165, the second connection portion 118 and the third connection portion 160 are formed together with each other. The eddy current loss may be restrained because the fourth connection portion is not provided inside of the second coil 112.

The present invention is not limited to the specifically disclosed embodiments, but variations and modifications may be made without departing from the scope of the present invention.

The present application is based on Japanese Patent Application No. 2007-254662, the entire disclosure of which is hereby incorporated by reference.

What is claimed is:

1. An electronic device comprising:

a substrate;

a first coil that has a spiral shape and is provided on the substrate;

a second coil that has a spiral shape, is provided above the first coil, and is spaced from the first coil;

a first connection portion that electrically couples the first coil and the second coil;

a wire that is provided on the substrate and connects one of the first coil and the second coil to outside; and a second connection portion that is mechanically connected to an outer side face of outermost circumference of the second coil and is mechanically connected on the substrate where one of the wire and the first coil is not provided.

2. The electronic device as claimed in claim 1, wherein the second connection portion is not provided inside of the second coil.

3. The electronic device as claimed in claim 1, wherein the second connection portion is electrically conductive.

4. The electronic device as claimed in claim 2, wherein the second connection portion is arranged at substantially equal interval on the circumference of the second coil.

5. The electronic device as claimed in claim 2 further comprising a third connection portion that is electrically coupled to the wire and the second coil on the substrate and is mechanically connected to the outer side face of the outermost circumference of the second coil, wherein the second connection portion and the third connection portion are arranged at substantially equal interval on the circumference of the second coil.

6. The electronic device as claimed in claim 1, wherein the first connection portion and the second connection portion are made of the same material.

7. The electronic device as claimed in claim 5, wherein the first connection portion, the second connection portion and the third connection portion are made of the same material.

8. The electronic device as claimed in claim 1, wherein the second connection portion includes an insulator.

9. The electronic device as claimed in claim 1 further comprising a fourth connection portion that is mechanically connected to inner side face of innermost circumference of the second coil, is mechanically connected on the substrate where one of the wire and the first coil is not provided, and includes an insulator.

* * * * *